United States Patent [19]

Gorski et al.

[11] 4,050,579

[45] Sept. 27, 1977

[54] PACKAGE FOR ORIENTING A PLURALITY OF ARTICLES

[75] Inventors: Dennis M. Gorski, Allendale; Dieter Neuber, Upper Saddle River, both of N.J.; Martin Michael Wildmoser, Staten Island, N.Y.

[73] Assignee: Arenco Machine Company, Inc., Teterboro, N.J.

[21] Appl. No.: 737,836

[22] Filed: Nov. 1, 1976

[51] Int. Cl.[2] ..... B65D 73/00; B65B 15/00

[52] U.S. Cl. ..... 206/460; 206/273; 206/429; 206/459; 229/42; 53/29; 156/211

[58] Field of Search ..... 206/273, 427, 429, 431, 206/459, 460; 53/29; 156/211, 297; 229/42

[56] References Cited

U.S. PATENT DOCUMENTS

| | | | |
|---|---|---|---|
| 2,677,460 | 5/1954 | Johnson et al. | 206/162 |
| 2,913,105 | 11/1959 | Brunsing | 206/429 |
| 2,944,718 | 7/1960 | Williamson | 206/427 X |
| 3,146,885 | 9/1964 | Hughes | 206/429 |
| 3,384,289 | 5/1968 | Grant | 229/42 X |
| 3,672,514 | 6/1972 | Tucker | 229/42 X |
| 3,675,767 | 7/1972 | Taylor | 206/432 X |
| 3,687,767 | 8/1972 | Reisman et al. | 156/211 X |
| 3,759,378 | 9/1973 | Werth | 206/192 |
| 3,924,739 | 12/1975 | Gravesteijn | 206/460 X |
| 3,991,880 | 11/1976 | Austrins et al. | 206/431 |

*Primary Examiner*—Robert S. Ward, Jr.
*Attorney, Agent, or Firm*—Lerner, David, Littenberg & Samuel

[57] ABSTRACT

A package is provided for holding a plurality of articles in a fixed orientation with respect to each other so that the articles are arranged for further processing, such as overwrapping, shrink-wrapping, case-packing, or the like. In one embodiment, the package includes a T-shaped member having a base and a divider which define an article support member on each side of the divider, with each of the article support members including one or more adhesive strips on either or both of the divider wall or base wall of each article support member. A row of articles is disposed in each of said article support members so that the articles adhere to the adhesive strips and are held in a fixed orientation with respect to each other. Such package may then be utilized for case-packing or may be further processed so that the package is overwrapped, shrink-wrapped, or the like.

In a second embodiment, peripheral wall sections, each including adhesive strips, are connected to each side of the base and are folded to extend in a direction parallel to the divider wall so as to engage and adhere to the side walls of the articles.

A method and apparatus are also provided for producing such packages.

22 Claims, 13 Drawing Figures

PACKAGE FOR ORIENTING A PLURALITY OF ARTICLES

FIELD OF THE INVENTION

The present invention relates generally to packaging, and specifically to an improved package which holds articles, including irregular-shaped articles, in a fixed orientation with respect to each other so that such articles may be easily case-packed, overwrapped, shrink-wrapped, or the like, while substantially reducing material and labor costs.

BACKGROUND OF THE INVENTION

There are presently many different types of packages on the market which are useful for holding a plurality of articles in a fixed orientation with respect to each other. For example, in the cigarette industry, the most common type of package which is employed is a folding carton which completely surrounds all four side walls and the two end walls of the package. Such a folding carton thereby requires a great deal of paperboard material. For example, in packaging 100 millimeter cigarettes, the blank size required to produce such a folding carton is approximately 175 square inches. However, the increasing costs of paperboard material have created a demand for a package which would accomplish the same purpose as the above-described folding carton but which would utilize substantially less paperboard material.

In addition, there are other inefficiences created by the folding-type carton presently employed in the cigarette industry. That is, after the folding carton is originally packed and sealed, during its distribution cycle, it must be reopened for further processing, such as tax stamping or price marking, and then resealed. Accordingly, it would be highly desirable to provide a package which also eliminated the inefficient steps of reopening and reclosing the package for tax stamping or the like, in addition to substantially reducing the paperboard material utilized.

There are also other industries which utilize inefficient and costly packages. For example, the multipacking of cans and plastic and glass containers, particularly those which have an irregular shape, is frequently accomplished through the use of a paperboard overwrap which completely surrounds the four side walls and two end walls of the package and which serves to hold the articles in a fixed orientation with respect to each other. It has been realized that there would be a great economic saving if such irregular-shaped articles could be shrink-wrapped with plastic instead of overwrapped with the more costly paperboard material. However, such irregular-shaped articles are difficult to shrink-wrap because they tend to change position and move out of alignment upon being subjected to the pressure of shrink-wrapping. Therefore, as such irregular-shaped articles are difficult to maintain in a fixed orientation with respect to each other, it has prevented such industries from taking advantage of the economic savings of shrink-wrapping. It would therefore be highly desirable to provide an inexpensive manner for maintaining such irregular-shaped articles in a fixed orientation with respect to each other so that they may be subjected to the pressure of shrink-wrapping and thereby avoid the higher costs of overwrapping the articles with paperboard material.

This problem also extends to the case-packing of irregular-shaped articles which must be maintained in a fixed orientation with respect to each other in order to be packed into a rectangular-shaped case. Typically, an outer paperboard sleeve must be utilized to hold the articles in the desired orientation for case-packing, even though the paperboard sleeve is normaly discarded when the case is unpacked for shelf stocking in stores. Again, it would also be highly desirable to provide a simple and less costly manner of maintaining the orientation of such irregular-shaped articles for case-packing which would not require the use of he more costly paperboard sleeves.

Broadly, it is an object of the present invention to provide an improved package which overcomes one or more of the aforesaid problems. Specifically, it is within the contemplation of the present invention to provide an improved package which is constructed from a minimum of paperboard material and still accomplishes the function of maintaining a plurality of articles, including irregular-shaped articles, in a fixed orientation with respect to each other so that such articles may be overwrapped, shrink-wrapped, case-packed, or the like.

It is a further object of the present invention to provide an improved package which substantially reduces material and labor costs and also increases the rate of packaging.

It is a still further object of the present invention to provide an improved package which maintains a plurality of articles in a fixed orientation with respect to each other, but leaves the end walls of the package exposed for further processing, such as tax stamping or price marking, and thereby eliminates the need for the inefficient steps of reopening and resealing packages.

It is also an object of the present invention to provide an inexpensive way of maintaining a plurality of irregular-shaped articles in a fixed orientation with respect to each other so that they may be shrink-wrapped or case-packed and thereby avoid the use of more costly paperboard overwraps or sleeves for such irregular-shaped articles.

SUMMARY OF THE INVENTION

Briefly, in accordance with the principles of the present invention, an improved package is provided which holds articles, including irregular-shaped articles, in a fixed orientation with respect to each other so that such articles may be easily overwrapped, shrink-wrapped, case-packed, or the like, while substantially reducing material and labor costs. In one embodiment, the package includes a T-shaped member having a base and a divider which define an article support member on each side of the divider, with each of the article support members including one or more adhesive strips on either or both of the divider wall or base wall of each article support member. A row of articles is disposed in each of the article support members so that the articles adhere to the adhesive strips and are held in a fixed orientation with respect to each other. The package may then be utilized for case-packing, or the package may then be overwrapped, shrink-wrapped, or the like.

In a second embodiment, peripheral wall sections, each including adhesive strips, are connected to each side of the base and are folded to extend in a direction parallel to the divider wall so as to engage and adhere to the side walls of the articles.

Of course, other embodiments of the present invention are also included herein. For example, if it is desired to package a single row of articles, instead of two rows of articles, only a single article support member would be utilized and would preferably be L-shaped. In addition, three or more rows of articles could also be packaged in accordance with the principles of the present invention by adding additional dividers and bases to the article support members which support two rows of articles. Further, it is also within the scope of the present invention to eliminate the base of the T-shaped article support members and thereby utilize only the divider wall between the rows of articles, with the adhesive strips extending along the divider walls to adhere the articles thereto. Such an embodiment would be utilized where the rigidity of the fina package is not critical. Finally, the present invention also contemplates the elimination of even the divider wall so that one or more adhesive strips are disposed between two rows of articles. In this manner, one row of articles is held to one side of the adhesive strip, and another row of articles is held to the other side of the adhesive strip so that all of the articles are held in a fixed orientation with respect to each other and thereby accomplishes the purpose of the present invention.

Advantageously, the package of the present invention utilizes substantially less paperboard material than presently-used packages or folding cartons. For example, in the cigarette industry, a cigarette package may be made in accordance with the principles of the present invention which utilizes only 63 square inches of paperboard material, as compared to the approximately 175 square inches presently used in folding cartons. Moreover, the package of the present invention also eliminates the inefficient steps of reopening and reclosing the package for tax stamping or the like. In the present invention, it is only necessary to overwrap the side walls of the package and thereby leaving the end walls of the package exposed for tax stamping or price marking.

As a further advantage of the present invention, there is provided an inexpensive manner for maintaining irregular-shaped articles in a fixed orientation with respect to each other so that they may be subjected to the pressure of shrink-wrapping and thereby avoid the higher costs of overwrapping the articles with paperboard material. In addition, the present invention also provides an inexpensive manner of packaging articles for case-packing which also avoid the use of the more costly paperboard-type packages or sleeves presently employed.

The present invention also provides a novel method and apparatus for producing such packages. The method of forming the packages utilizes paperboard roll stock to which adhesive films are applied. The paperboard stock is then scored and folded so as to form the desired configuration, such as a T-shaped article support member. Then, a row of articles is deposited on each article support member to adhere the articles to the adhesive film so that the articles are held in a fixed orientation with respect to each other. Depending on the type of package being formed, a wrapping film may then be applied to the oriented articles to cover the side walls of the package.

Advantageously, the method of the present invention allows the packages to be formed with an in-plant converting system wherein paperboard roll stock is utilized to form the packages as needed. In addition, the strength of the paperboard stock and/or the adhesive films may be varied in accordance with the types of articles being packaged to provide optimum use of the package of the present invention.

BRIEF DESCRIPTION OF THE DRAWINGS

Further objects, features, and advantages of the present invention will become apparent upon the consideration of the following detailed description of presently-preferred embodiments when taken in conjunction with the accompanying drawings, wherein.

DETAILED DISCUSSION OF FIRST EMBODIMENT OF THE INVENTION

Figure 1:
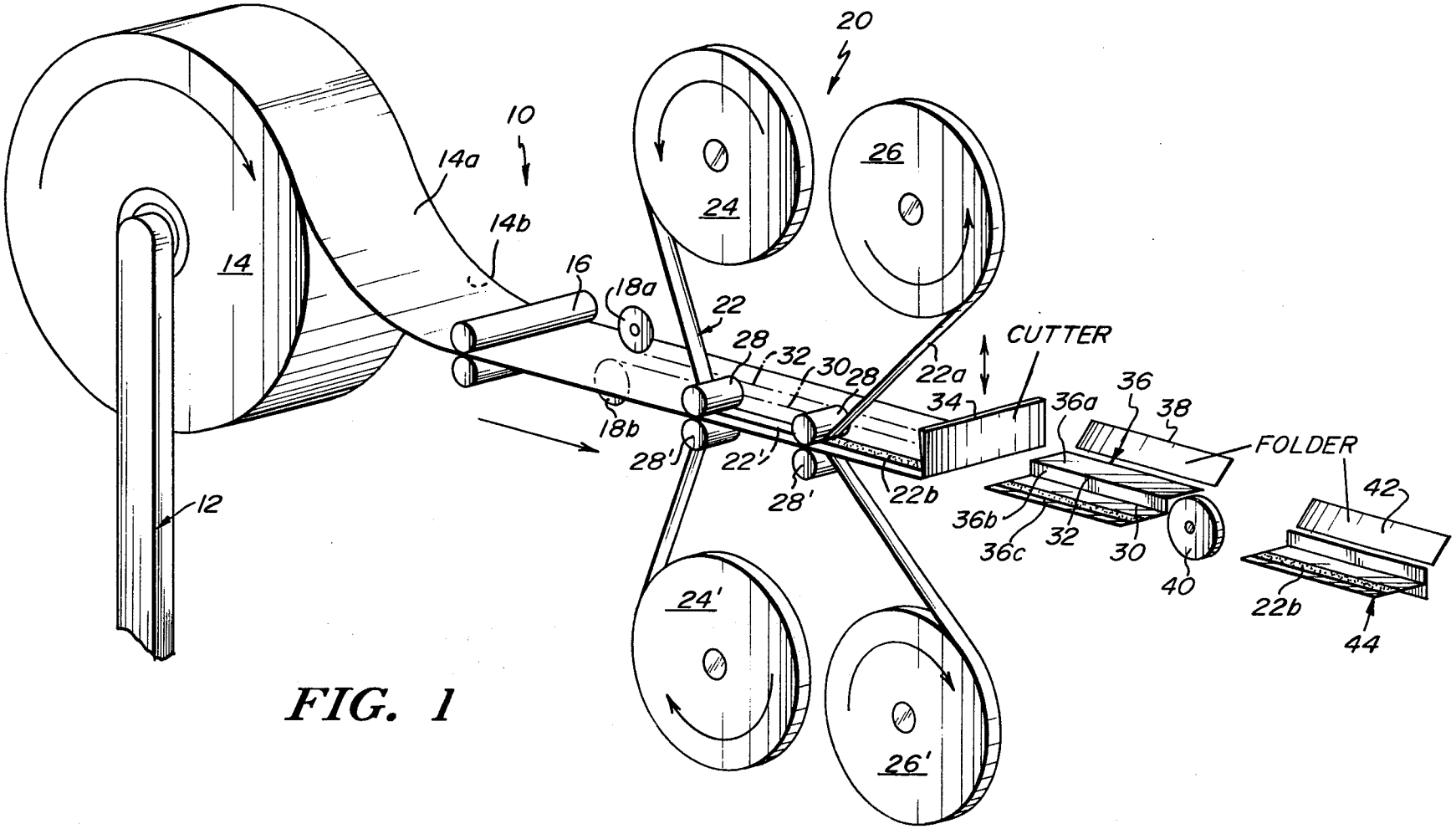
FIG. 1 is a diagrammatic illustration of the method of the present invention for forming a package.
Figure 2:
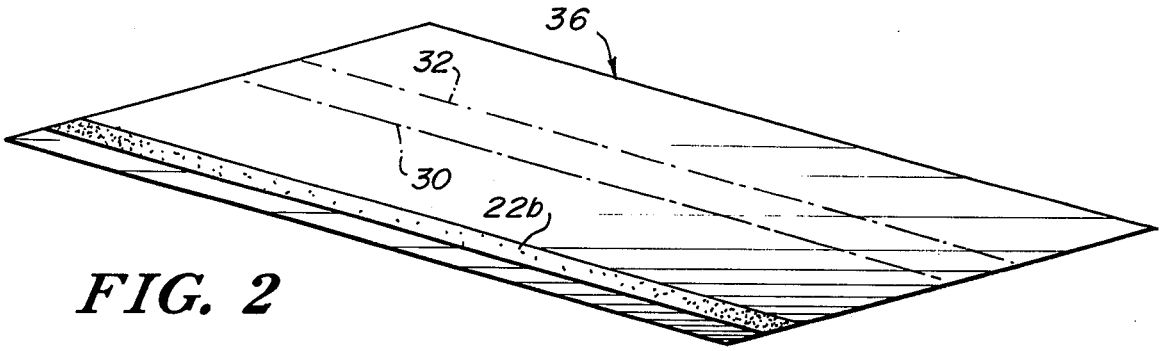
FIG. 2 is a top plan view of the blank from which the package is formed after it has been scored and the adhesive strips applied thereto.
Figure 3:
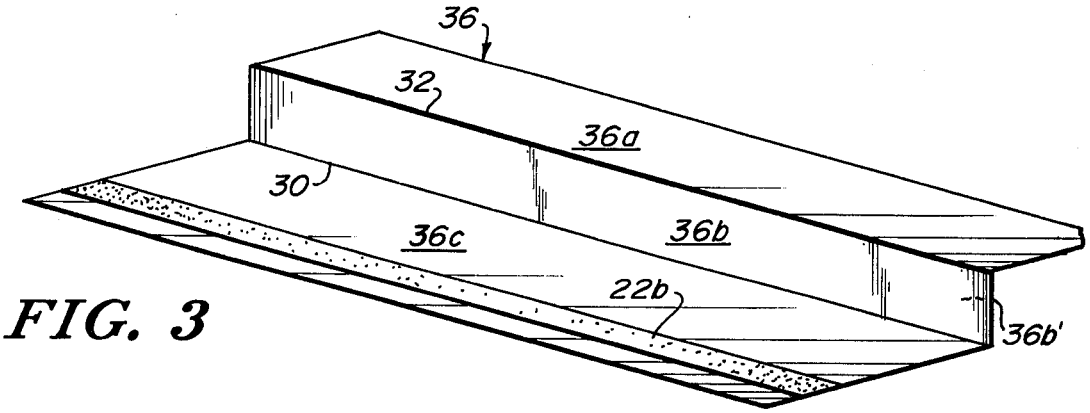
FIG. 3 illustrates the blank in its partially-folded condition.

Referring now to FIG. 1, there is shown the improved apparatus, method and package of the present invention, generally designated by the reference numeral 1, which includes conventional means 12 for supplying paperboard roll stock 14 to a series of work stations. The supplying means includes guiding rollers 16 for directing the paperboard stock to the work stations. The roll stock 14 includes an upper side **14*a* and a lower side 14*b*. Scoring rolls 18*a*, 18*b* are provided to form spaced-apart score lines 30, 32 in the upper and lower sides 14*a*, 14*b*, respectively, of paperboard stock 14. Of course, any suitable means may be employed for forming lines of weakness in the paperboard stock 14** at spaced-apart locations and may also include means for slitting or perforating the paperboard stock to form the lines of weakness utilized for subsequent folding.

As also seen in FIG. 1, paperboard roll stock 14 is then directed to an adhesive-applying station 20 for applying adhesive to the upper and lower sides **14*a*, 14*b* of paperboard roll stock 14. The adhesive-applying station 20 includes a supply reel 24 for applying adhesive tape 22 to the paperboard stock and a take-up reel 26 for taking up the backing paper 22*a* which is removed from the adhesive tape 22 as it is applied to expose the adhesive surface 22*b*. Pressure rolls 28 are employed for applying and pressing the adhesive strip 22 to the paperboard stock. In the preferred embodiment, the adhesive tape 22 is a double-sided adhesive strip having adhesive characteristics on both sides, with the adhesive characteristics being stronger on the side applied to the paperboard than on side 22***b*. In this manner, the adhesive strip 22 strongly adheres to the paperboard stock but only weakly adheres to the articles to be attached thereto, in a manner to be explained. Of course, any suitable adhesive tape or film or glue may be applied to the upper and lower surfaces 14*a*, 14*b* of paperboard roll stock 14 in accordance with the principles of the present invention. The only requirement is that the adhesive tape or film or glue adhere more strongly to the paperboard stock than to the articles to be attached thereto. A similar arrangement for applying adhesive tape 22' to the lower side 14*b* of the paperboard stock is also shown and includes supply reel 24', take-up reel 26', and pressure rolls 28'.

The paperboard stock 14, having the score lines 30, 32 formed on both sides hereof and having adhesive strips 22, 22' applied to both sides thereof, is directed to a cutting station where suitable apparatus 34 is provided for cutting the paperboard roll stock 14 transversely to form a blank 36. Suitable means are then provided for folding blank 36 about score lines 30, 32, and such means may include a conventional folder, diagrammatically represented by reference numeral 38. Folder 38 operates to fold blank 36 at approximately a 90° angle along each score line 30, 32 to form a blank having an offset section 36*a*, a bent section 36*b* extending in a direction perpendicular to the offset section 36*a*, and a planar section 36*c* extending in a direction perpendicular to the bent section 36*b*. Suitable means, such as a glue wheel applicator 40, then operates to apply glue to the lower side 14*b* of blank 36, and particularly to the lower side of bent section 36*b'* of blank 36. Then, partially-folded blank 36 is directed to another folding apparatus 42, shown diagrammatically in FIG. 1 and which may be of conventional structure. Folder 42 operates to adhere the offset section 36*a* of blank 36 to the bent section 36*b* to form a T-shaped member 44.

Figure 4:
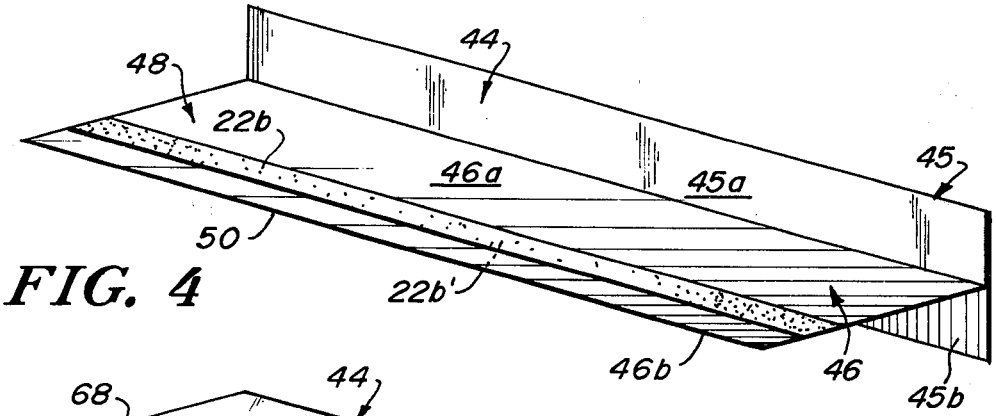
FIG. 4 illustrates the blank folded to form the T-shaped member of the present invention.

As shown most clearly in FIG. 4, the T-shaped member 44 includes a base wall 45 and a divider wall 46. Base wall 45 includes a first base portion 45*a* on one side of divider wall 46, and a second base portion 45*b* on the other side 46*b* of divider wall 46. In this manner, wall 46*a* of divider 46 and base portion 45*a* form a first article support member 48, whereas side 46*b* of divider wall 46 and base portion 45*b* together form another article support member 50. As will be understood, article support member 48 includes adhesive strip 22*b*, and article support member 50 includes adhesive strip 22*b'*.

Figure 5:
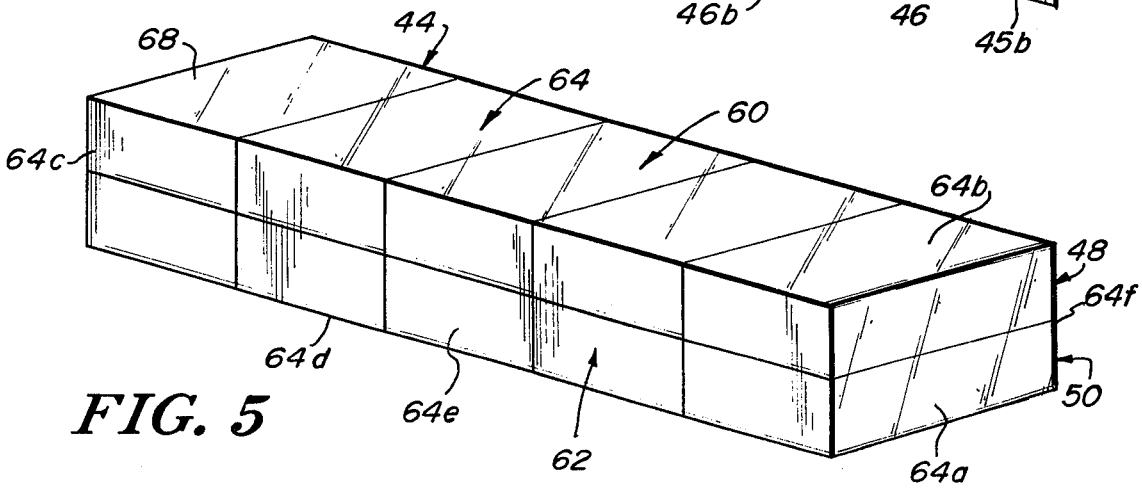
FIG. 5 illustrates the two rows of articles deposited on the T-shaped member.

Referring to FIG. 5, T-shaped member 44 is then supplied to a loading station where the articles or products to be packaged are deposited on the T-shaped member. Of course, any conventional apparatus of transferring the articles and depositing same on the T-shaped member 44 may be employed. However, the only requirement of such apparatus is that the articles do not engage the divider wall 46 or the adhesive strips 22*b*, 22*b'* until the articles are in their proper position relative to the T-shaped member 44. The delivery apparatus operates to deposit a first row of articles 60 on article support member 48, and a second row of articles 62 on article support member 50. In this manner, articles 60, 62 adhere to adhesive strips 22*b*, 22*b'*, respectively, on each of the article support members 48, 50, respectively, so that the articles 60, 62 are held in a fixed orientation with respect to each other on T-shaped member 44.

With the articles held in a fixed orientation with respect to each other, they may be supplied to a next station for further processing, such as overwrapping, shrink-wraping, case-packing, or the like. In the present embodiment, T-shaped member 44 and articles 60, 62 are transferred to an overwrapping station (not shown) which is of conventional structure and operates to overwrap articles 60, 62 with wrapping film 68 to form a package 64. However, in accordance with the principles of the present invention, the wrapping film 68 is applied to the oriented articles 60, 62 to cover only the four side walls 64*a*, 64*b*, 64*c*, and 64*d* of package 64. In this manner, the two end walls 64*e*, 64*f* remain exposed for further processing, such as tax stamping or price marking, or the like.

As will be understood, the package 64 utilizes a minimum of paperboard material to maintain the articles in their fixed orientation with respect to each other and, in addition, if the articles being packaged are cigarettes, the inefficient steps of reopening and reclosing the end wall of the package for tax stamping or the like is eliminated.

DETAILED DISCUSSION OF SECOND EMBODIMENT OF THE INVENTION

Figure 6:
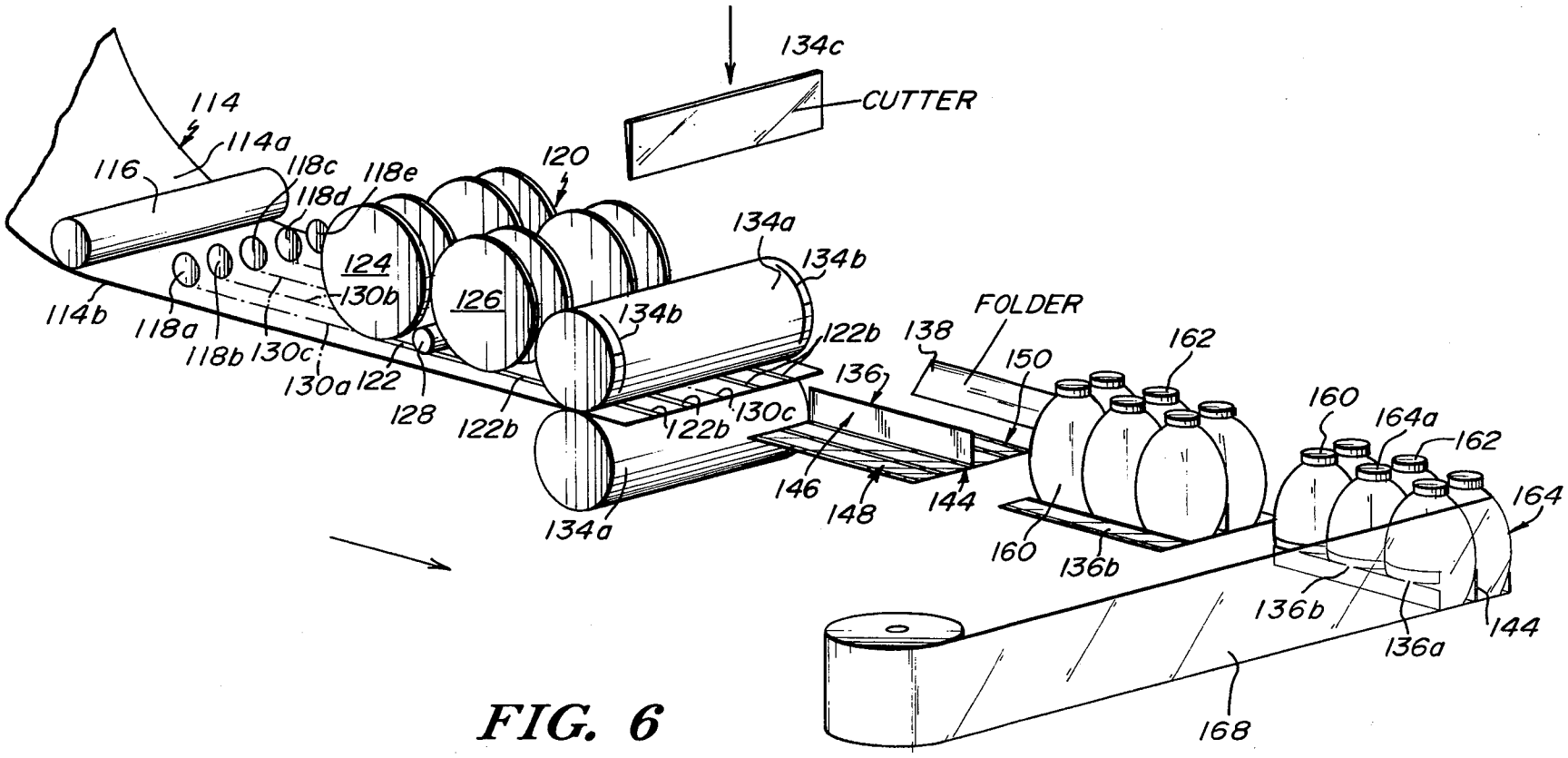
FIG. 6 is a diagrammatic illustration of a second method in accordance with the present invention for forming a package.

Referring now to FIG. 6, there is shown another embodiment of the present invention, generally designated by the reference numeral 110, which include conventional means (not shown) for supplying paperboard roll stock 114 to a series of work stations. The supplying means includes guiding rollers 116 for directing the paperboard stock to the work stations. The roll stock 114 includes an upper side 114*a* and a lower side 114*b*. Soring rolls 118*a*, 118*b*, 118*c*, 118*d*, and 118*e* are provided to form respective score lines 130*a*, 130*b*, 130*c*, 130*d*, and 130*e* in the upper side 114*a* of paperboard stock 114. Alternatively, slitting means or perforating means may be employed to form the lines of weakness which are utilized for subsequent folding operations.

As is also seen in FIG. 6, paperboard roll stock 114 is then directed to an adheisve-applying station 120 for applying adhesive to the upper side 114*a* of paperboard roll stock 114. The adhesive-applying station 120 includes four suply reels 124, each for applying a strip of adhesive tape 122 to the paperboard stock, and an equal number of take-up reels 126 for taking up the backing paper 122*a* which is removed from the adhesive tape 122 as it is applied so as to expose the adhesive surfaces 122*b*. A pressure roll 128 is employed for applying and pressing the dhesive strips 122 to the paperboard stock. In the preferred embodiment, the adhesive tapes 122 are doublesided adhesive strips having adhesive characteristics on both sides, with the adhesive characteristics being stronger on the side applied to the paperboard than on sides 122*b*.

Figure 7:
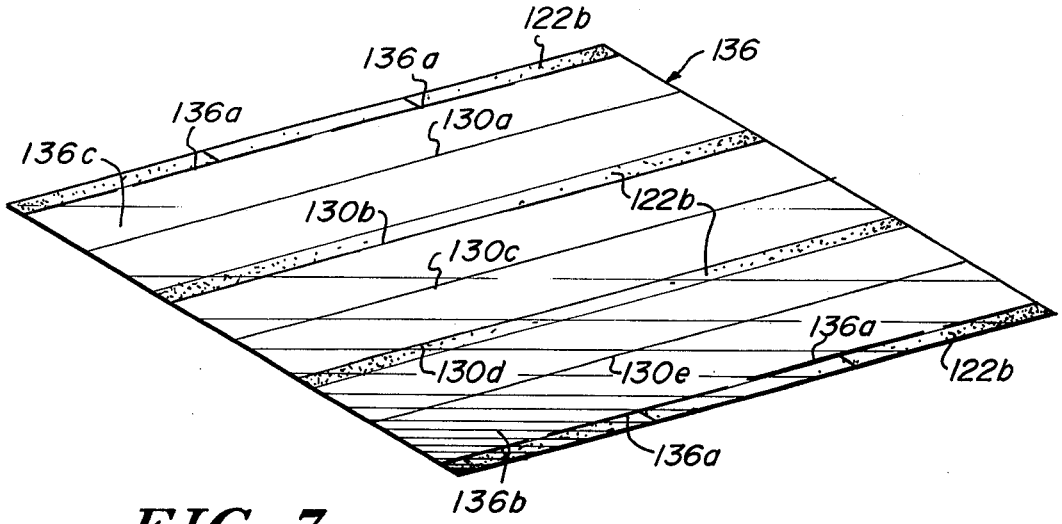
FIG. 7 is a planar view of a blank formed in accordance with the second method.
Figure 8:
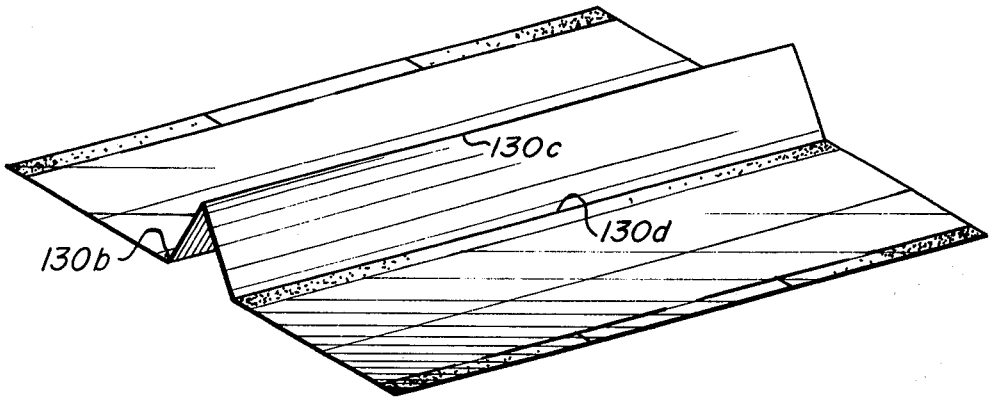
FIG. 8 is a perspective view illustrating the blank in its partially-folded condition.
Figure 9:
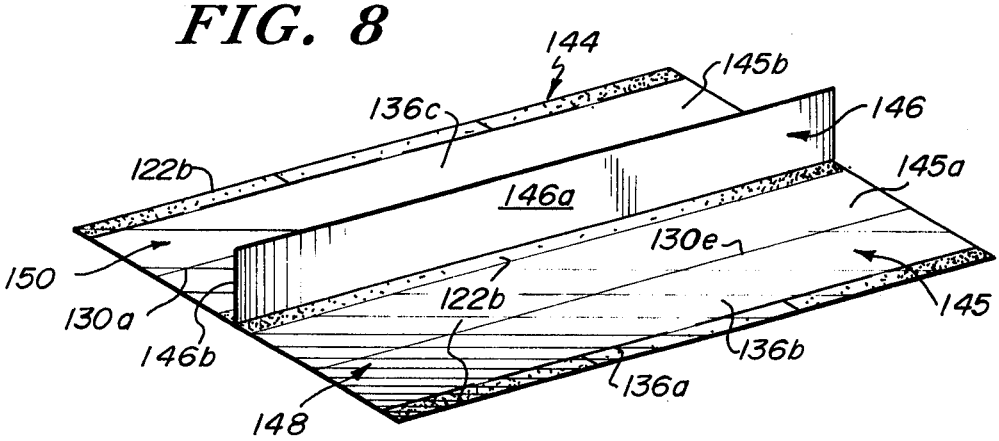
FIG. 9 illustrates the blank folded and glued to form the T-shaped member of the present invention.
Figure 10:
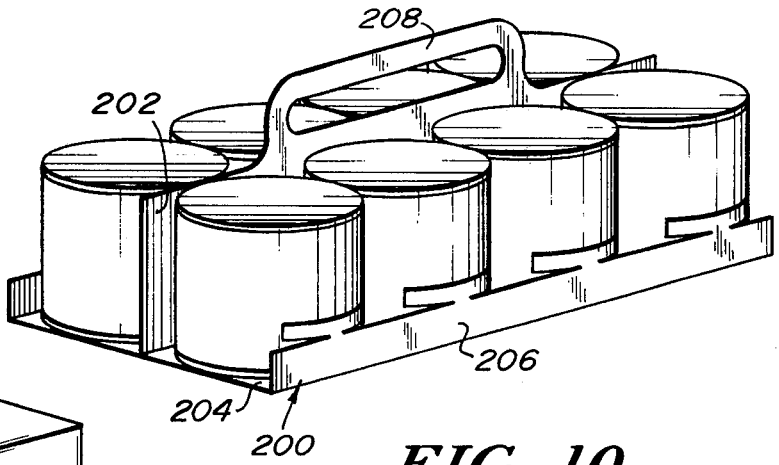
FIG. 10 is a perspective view of another package formed in accordance with the present invention.

The paperboard stock 114, having the score lines 130*a* through 130*e* formed thereon and having the four adhesive strips 122*b* applied thereto, is directed to a cutting and slitting station where suitable apparatus 134*e* is provided having slitters 134*b* formed thereon for forming slits 136*a* in the outer peripheries 136*b*, 136*c* of the paperboard roll stock 114. (See FIG. 7.) In addition, suitble apparatus 134*c* is provided for cutting the paperboard roll stock 114 transversely to form a blank 136. A folding apparatus, diagrammatically represented by numeral 138, is provided for folding blank 136 about score lines 130c, 130d, and 130e. (See FIG. 8.) Folder 138 operates to fold blank 136 at approximately a 90° angle along each score line 130b, 130c, and 130d to form a T-shaped member 144 having a divider wall 146 extending in a direction perpendicular to a base wall 145. Suitable means, such as a glue wheel applicator (not shown), operates to apply glue to the walls of divider 146 so that they are permanently adhered. Referring to FIG. 9, base wall 145 includes a first base portion 145a on one side 146a of divider wall 146 and a second base portion 145b on the other side 146b of divider wall 146. In this manner, wall 146a of divider 146 and base portion 145a form a first article support member 148, whereas side 146b of divider wall 146 and base portion 145b together form another article support member 150. As will be understood, article support member 148 includes adhesive strips 122b adjacent wall 146a and on peripheral wall 136b, and article support member 150 includes adhesive strips 122b adjacent wall 146b and on peripheral wall 136c.

Referring again to FIG. 6, T-shaped member 144 is then supplied to a loading station where the articles or products to be packaged are deposited on the T-shaped member. Of course, any conventional apparatus for transferring the articles and depositing same on the T-shaped member 144 may be employed. The delivery apparatus operates to deposit a first row of articles 160 on article support member 148 and a second row of articles 162 on article support member 150. In this manner, articles 160, 162 adhere to the adhesive strips 122b adjacent divider wall 146 on each of the article support members 148, 150, respectively, so that the articles 160, 162 are held in a fixed orientation with respect to each other on T-shaped member 144.

As shown in FIG. 6, the package is then supplied to another folding station which operates to fold the peripheral or outer wall sections 136b, 136c of blank 136 upwardly and about score lines 130e, 130a, respectively, to engage and adhere to the walls of articles 160, 162. As will be seen most clearly in FIG. 6, as a result of the slits 136a formed in the peripheral sections 136b, 136c of the blank and adhesive strips 122b, they conform to and adhere to the walls of the articles 160, 162, even if such articles are irregular in shape.

With the articles held in a fixed orientation with respect to each other, they may then be supplied to a next station for further processing, such as overwrapping, shrink-wrapping, case-packing, or the like. In the present embodiment, T-shaped member 144 and articles 160, 162 are transferred to an overwrapping station (not shown) which is of conventional structure and operates to overwarp articles 160, 162 with wrapping film 168 (see FIG. 6) to form a completed package 164. However, in accordance with the principles of the present invention, the wrapping film 168 is applied to the oriented articles 160, 162 to cover only the four side walls of the package 164. In this manner, the two end walls 164a remain exposed for further processing, such as price marking or the like. As will be understood, the package 164 utilizes a minimum of paperboard material to maintain the articles in their fixed orientation with respect to each other.

DISCUSSION OF ADDITIONAL EMBODIMENTS OF THE INVENTION

Turning now to FIGS. 10 to 13, there are shown a number of different packages employing the concepts of the present invention. More particularly, in FIG. 10, there is shown a package 200 which includes a center divider wall 202, a base portion 204, and peripheral outer wall sections 206 which conform to and adhere the side walls of the articles. In addition, in this modification, the divider wall 202 has been extended to the height of the articles, and the upper end thereof has been provided with a suitable carrying member or handle 208 for conveniently carrying the package 200.

Figure 11:
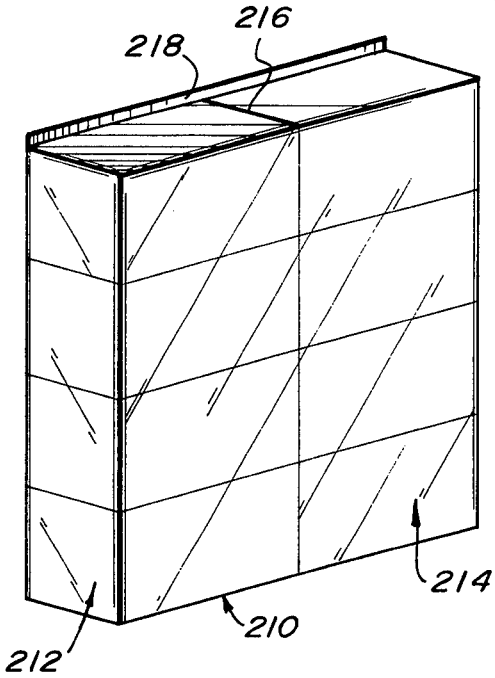
FIG. 11 is a still further embodiment of a package in accordance with the present invention.

As shown in FIG. 11, there is a package 210 also embodying the concepts of the present invention. In this embodiment, the rows of articles 212, 214 are arranged in a vertical orientation with respect to each other so as to form a vertical display for displaying articles, such as photographic film. In a manner similar to the first embodiment, package 210 includes a center divider wall 216 and a base wall 218.

Figure 12:
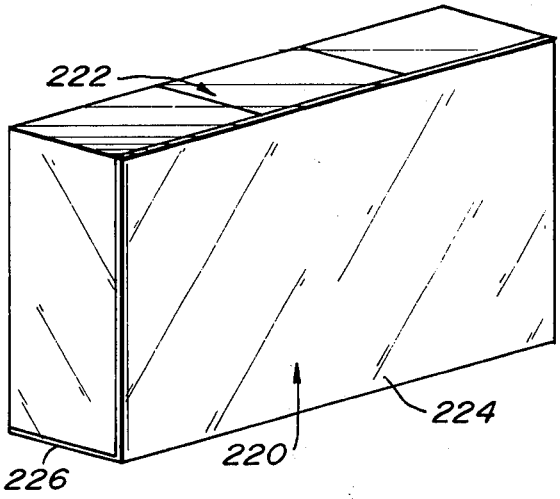
FIG. 12 illustrates an additional embodiment of a package in accordance with the present invention.

Referring to FIG. 12, there is shown a modified package 220 embodying the concepts of the present invention. Package 220 has an L-shaped configuration for packaging only a single row of articles 222 and includes a vertical wall 224 and a base wall 226. The adhesive film (not shown) may be placed on either or both of these walls.

Figure 13:
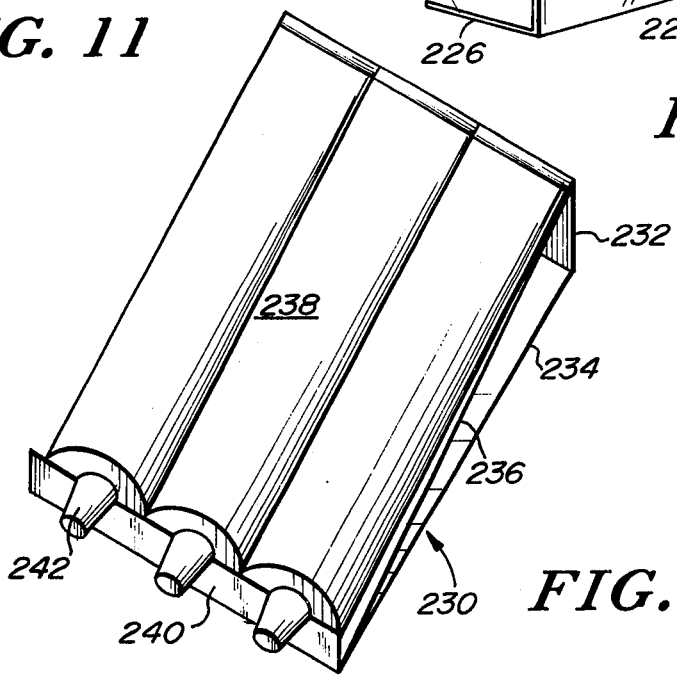
FIG. 13 illustrates a further embodiment of a package formed in accordance with the principles of the present invention.

Finally, now turning to FIG. 13, there is shown a package 230 employing the concepts of the present invention which is formed from a substantially L-shaped configuration including a base wall 232 and a rear wall 234. In addition, there is an article support wall 236 which conforms to the shape of the article and to which the adhesive film (not shown) is applied adjacent the base 232 for adhering the articles 238 to the package. In addition, in this embodiment, a collar member 240 is formed to engage the caps 242 of the articles for retaining the articles in engagement with the package 230. Of course, alternatively, a second strip of adhesive may be applied to the top end of article support wall 236 to adhere the articles to the packages instead of employing collar member 240.

Further, it should also be pointed out that the packages of the present invention may be formed from other suitable materials, in addition to paperboard material. For example, suitable plastic materials may be employed to form the T-shaped or L-shaped members of the present invention. In addition, such plastic materials may be shaped by an extrusion process to form the required T-shaped or L-shaped members.

In view of the foregoing, it should be clear that there has been provided in accordance with the present invention a package for holding a plurality of articles, including irregular-shaped articles, in a fixed orientation with respect to each other so that such articles may be more easily case-packed, overwrapped, shrink-wrapped, or the like, while substantially reducing material and labor costs.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A package for packaging a plurality of articles in a fixed orientation with respect to each other comprising:

a rigid blank having first and second sides, said rigid blank being a T-shaped member including a base wall and a divider wall which define an article support member on each side of said divider wall;

each article support member including an adhesive strip on the divider wall of each of said article support members;

a row of articles disposed on one of said article support members and another row of articles disposed on the other of said article support members so that said articles adhere to the adhesive strip on each side of said divider wall and are thereby held in a fixed orientation with respect to each other, said rows of articles on either side of said divider wall being supported by the base wall of each of said article support members; and a wrapping film covering the four sidewalls of the package, with at least one end wall being exposed.

2. The package of claim 1 wherein said T-shaped member further includes a peripheral section on each side of said base wall extending in a direction substantially parallel to said divider wall and engaging the side walls of said articles so that said articles are held in a fixed orientation with respect to each other.

3. The package of claim 2 wherein each of said peripheral sections includes an adhesive film for adhering said peripheral sections to the side walls of said articles.

4. The package of claim 2 wherein each of said peripheral sections includes slits for allowing said peripheral sections to conform to and engage the side walls of irregular-shaped articles.

5. The package of claim 1 wherein adhesive film is on the base wall of each of said article support members for adhering to said articles.

6. A method of packaging a plurality of articles comprising the steps of:

supplying rigid stock material having first and second sides;

applying at least two adhesive strips to said stock material;

forming first and second lines of weakness in said stock material at spaced-apart locations;

cutting a portion of said stock material to form a blank;

folding said blank about said first and second lines of weakness to form a T-shaped member including a base wall and a divider wall which define an article support member on each side of said divider wall, each article support member including at least one of said adhesive strips on the divider wall of each of said article support members;

depositing a row of articles on the article support member on the first side of said blank and depositing another row of articles on the article support member on the second side of said blank to adhere said articles to said adhesive strips on said divider wall and to support said articles on the base wall of each of said article support members so that said articles are held in a fixed orientation with respect to each other; and applying a wrapping film to said oriented articles to cover the four sidewalls of the package, leaving at least one of the end walls of the package exposed for further processing.

7. The method of claim 6 wherein the step of folding said blank to form a T-shaped member includes the following steps:

folding said blank at approximately a 90° angle along each of said first and second lines of weakness to form a blank having an offset section and a bent section extending in a direction perpendicular to said offset section;

applying adhesive to one side of said blank; and adhering the offset section of said blank to the bent section of said blank to form said T-shaped member.

8. The method of claim 6 wherein the step of forming said first and second lines of weakness includes the step of scoring the first and second sides of said stock at spaced-apart locations.

9. The method of claim 6 wherein the step of folding said blank into a T-shaped member includes the step of forming a peripheral foldable section on each side of said base wall.

10. The method of claim 9 further including the step of folding said peripheral sections of said blank to engage the side walls of said articles so that said articles are held in a fixed orientation with respect to each other.

11. The method of claim 10 further including the step of applying an adhesive film to each of said peripheral sections for adhering said peripheral sections to the side walls of said articles.

12. The method of claim 11 further including the step of forming slits in said peripheral sections so that said peripheral sections conform to and engage the side walls of irregular-shaped articles.

13. A method of packaging a plurality of articles comprising the steps of:

supplying paperboard stock having first and second sides;

applying adhesive film to the first and second sides of said paperboard stock;

forming first and second lines of weakness in said paperboard stock at spaced-apart locations;

cutting a portion of said paperboard stock to form a blank;

folding said blank about said first second lines of weakness to form a T-shaped member including a base and a divider which define an article support member on each side of said divider, each article support member including said adhesive film;

depositing a row of articles on one of said article support members and depositing another row of articles on the other of said article support members to adhere said articles to the adhesive film on each of said article support members so that said articles are held in a fixed orientation with respect to each other; and applying a wrapping film to said oriented articles to cover the four side walls of the package and leaving at least said base or one end of said articles exposed for further processing.

14. The method of claim 13 wherein the step of folding said blank to form a T-shaped member includes the steps of:

folding said blank at approximately a 90° angle along each of said first and second lines of weakness to form a blank having an offset section and a bent section extending in a direction perpendicular to said offset section;

applying adhesive to one side of said blank; and adhering the offset section of said blank to the bent section of said blank to form said T-shaped member.

15. The method of packaging a plurality of articles comprising the steps of:

supplying paperboard stock having first and second sides;

applying at least two spaced-apart films of adhesive to a first side of said paperboard stock;

forming a plurality of spaced-apart lines of weakness in said paperboard stock;

cutting a portion of said paperboard stock to form a blank;

folding said blank about said lines of weakness to form a T-shaped member including a base, a divider, and a peripheral foldable section formed on each side of said base, with at least one adhesive film being on each side of said divider; and depositing a row of articles on the first side of said divider and depositing another row of articles on the second side of said divider to adhere said articles to said adhesive films and to engage said base so that said articles are held in a fixed orientation with respect to each other.

16. The method of claim 15 further including the step of applying a wrapping film to said oriented articles to cover the four side walls of the package and leaving at least said base or one end of said articles exposed for further processing.

17. The method of claim 15 wherein the step of applying adhesive film to said paperboard stock includes the step of applying adhesive film to each of said peripheral sections and applying adhesive film to the base on each side of said divider.

18. The method of claim 17 further including the step of folding said peripheral sections on said blank to engage the side walls of said articles so that said adhesive films on said peripheral sections adhere to the side walls of said articles to hold said articles in a fixed orientation with respect to each other.

19. The method of claim 18 further including the step of forming slits in said peripheral sections for allowing said peripheral sections to conform to and engage the side walls of irregular-shaped articles.

20. Apparatus for packaging a plurality of articles in a fixed orientation with respect to each other comprising:

means for supplying paperboard stock having first and second sides;

means for applying adhesive to said paperboard stock;

means for forming first and secnd lines of weakness in said paperboard stock at spaced-apart locations;

means for cutting a portion of said paperboard stock to form a blank;

means for folding said blank about said first and second lines of weakness to form a T-shaped member including a base and a divider which deine an article support member on each side of said divider, with each of said article support members including said adhesive;

means for depositing a row of articles in one of said article support members and means for depositing another row of articles in the other of said article support members to adhere said articles to the adhesive in each of said article support members so that said articles are held in a fixed orientation with respect to each other; and means for applying a wrapping film to said oriented articles to cover the four side walls of the package so that at least one of the end walls of said package is exposed for further processing.

21. The apparatus of claim 20 further including means for forming a peripheral outer section on each side of said base and means for folding said peripheral sections to engage the side walls of said articles.

22. The apparatus of claim 21 wherein said adhesive-applying means apply adhesive to each of said peripheral sections so that said peripheral sections adhere to the side walls of said articles.

* * * * *

UNITED STATES PATENT OFFICE

CERTIFICATE OF CORRECTION

Patent No. 4,050,579 Dated September 27, 1977

Inventor(s) Dennis M. Gorski, et al.

It is certified that error appears in the above-identified patent and that said Letters Patent are hereby corrected as shown below:

Column 2, line 12, "he" should read -- the --.

Column 4, line 45, "1" should read -- 10 --.

Column 5, line 55, "of" should read -- for --.

Column 6, line 6, "wraping" should read -- wrapping --;
line 44, "adheisve" should read -- adhesive --;
line 62, "134e" should read -- 134a --.

Column 10, line 37, after "first" insert -- and --.

Column 12, line 8, "secnd" should read -- second --;
line 14, "deine" should read -- define --.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*